US008561667B1

(12) United States Patent
Hanley et al.

(10) Patent No.: US 8,561,667 B1
(45) Date of Patent: Oct. 22, 2013

(54) WINDOW TREATMENT WITH KNUCKLE JOINT DRIVER

(75) Inventors: Michael Hanley, Smithfield, RI (US); Leo E. LaBarre, Woonsocket, RI (US)

(73) Assignee: Kenney Manufacturing Co., Warwick, RI (US)

( * ) Notice: Subject to any disclaimer, the term of this patent is extended or adjusted under 35 U.S.C. 154(b) by 0 days.

(21) Appl. No.: 13/165,756

(22) Filed: Jun. 21, 2011
(Under 37 CFR 1.47)

Related U.S. Application Data

(60) Provisional application No. 61/357,252, filed on Jun. 22, 2010.

(51) Int. Cl.
*E06B 9/38* (2006.01)

(52) U.S. Cl.
USPC ..... 160/168.1 R; 160/309; 160/178.1 R; 160/173 R

(58) Field of Classification Search
USPC ..... 160/22, 66, 70, 84.01, 84.04, 84.05, 160/170, 171, 177 V, 120, 241, 309, 160/168.1 R, 173 R, 178.1 R; 464/120, 115, 464/106
See application file for complete search history.

(56) References Cited

U.S. PATENT DOCUMENTS

| | | | | | |
|---|---|---|---|---|---|
| 913,424 | A * | 2/1909 | Nehring | 74/412 R |
| 937,169 | A * | 10/1909 | Noepel | 74/423 |
| 960,061 | A * | 5/1910 | Baaden | 464/106 |
| 1,744,686 | A * | 1/1930 | Pease et al. | 160/309 |
| 1,833,688 | A * | 11/1931 | Nelson et al. | 160/22 |
| 2,143,348 | A * | 1/1939 | Gibson | 464/148 |
| 2,784,573 | A * | 3/1957 | Anderson | 464/106 |
| 2,815,179 | A * | 12/1957 | Keljik | 242/389 |
| 3,021,964 | A * | 2/1962 | Metzger | 213/167 |
| 3,389,738 | A | 6/1968 | Roth | |
| 5,092,387 | A * | 3/1992 | King et al. | 160/176.1 R |
| 5,465,775 | A * | 11/1995 | Biba et al. | 160/168.1 R |
| 5,465,779 | A * | 11/1995 | Rozon | 160/168.1 V |
| 5,472,035 | A * | 12/1995 | Biba et al. | 160/168.1 R |
| 5,819,832 | A * | 10/1998 | Huang | 160/168.1 R |
| 5,845,695 | A * | 12/1998 | Cadorette et al. | 160/173 V |
| 5,850,863 | A * | 12/1998 | Huang | 160/168.1 R |
| 5,950,701 | A * | 9/1999 | Rogers | 160/177 V |
| 6,195,868 | B1 * | 3/2001 | Etherington et al. | 29/522.1 |
| 6,196,293 | B1 * | 3/2001 | Lee | 160/168.1 V |
| 6,581,666 | B1 * | 6/2003 | Bartholin et al. | 160/177 R |

(Continued)

FOREIGN PATENT DOCUMENTS

WO WO2006/021607 A2 2/2006

*Primary Examiner* — Katherine Mitchell
*Assistant Examiner* — Johnnie A Shablack
(74) *Attorney, Agent, or Firm* — C. Nessler

(57) ABSTRACT

A window treatment, in which a shade is raised and lowered, is comprised of a roller upon which shade material is reeled and unreeled. A wand drives a universal joint, preferably a uniquely configured knuckle joint, and the universal joint drives a flexible shaft which is connected to the roller. Special shaping of the parts and slots of the U shape links of mating knuckles enables smooth and positive universal joint operation. A user may pull down on the wand, to bend the flexible shaft and bring the knuckles into alignment, whereupon turning of the wand rotates the roller. When the wand is released the resilience of the flexible shaft helps lift the driven knuckle so it is parallel to the horizontal roller, and the drive roller moves to a home position which inhibits counter-rotation of the roller due to the weight of the shade.

16 Claims, 4 Drawing Sheets

(56) References Cited

U.S. PATENT DOCUMENTS

| | | | | |
|---|---|---|---|---|
| 6,651,721 | B2 * | 11/2003 | Allsopp | 160/168.1 V |
| 6,786,270 | B2 * | 9/2004 | Wen et al. | 160/170 |
| 6,910,516 | B2 * | 6/2005 | Huang | 160/170 |
| 6,973,952 | B2 * | 12/2005 | Nien | 160/170 |
| 7,204,292 | B2 * | 4/2007 | Nien | 160/168.1 R |
| 7,426,954 | B2 * | 9/2008 | Bohlen et al. | 160/177 V |
| 7,581,579 | B2 * | 9/2009 | McCormick et al. | 160/309 |
| 8,066,050 | B2 * | 11/2011 | Lin | 160/84.04 |
| 8,205,658 | B1 * | 6/2012 | Lin | 160/320 |
| 2002/0062931 | A1 * | 5/2002 | Allsopp | 160/168.1 R |
| 2004/0103995 | A1 * | 6/2004 | Nien | 160/170 |
| 2004/0134627 | A1 * | 7/2004 | Huang | 160/170 |
| 2005/0000663 | A1 * | 1/2005 | Nien | 160/168.1 R |
| 2009/0020303 | A1 * | 1/2009 | Gooding | 173/218 |
| 2011/0186246 | A1 * | 8/2011 | Lin | 160/309 |
| 2011/0214823 | A1 * | 9/2011 | Hu et al. | 160/168.1 R |

* cited by examiner

WINDOW TREATMENT WITH KNUCKLE JOINT DRIVER

This application claims benefit of provisional patent application Ser. No. 61/357,252, filed Jun. 22, 2010.

TECHNICAL FIELD

The present invention relates to means for raising and lowering coverings for windows and other openings, in particular, to means for rotating a roller to which is fastened shade or the like.

BACKGROUND

Shades used for covering window openings and the like are commonly raised and lowered, to change the extent of blockage of an opening, by winding and unwinding—or reeling and unreeling, the shade on a roller. In the past, a roller has been driven in various ways, including by having a manually driven shaft, called a wand here, which is connected to the roller by a universal joint, a flexible shaft, a gear box and so forth. A universal joint (also called a U-joint) is a familiar mechanical fitting which allows the axis of a rotatable driving member to be offset from the axis of the driven member. U.S. Pat. No. 1,744,686 of Pease shows a relatively crude universal joint comprising two interlaced loops, for driving a gear system of a roller. U.S. Pat. No. 7,204,292 of Nien shows a universal joint in combination with a worm gear which drives a roller.

Particularly when the fabric of a shade is heavy, the weight of the hanging-down portion of the shade can cause the roller to turn, thus allowing the shade to unwind from its desired set position. Such kind of motion is sometimes referred to here as counter-rotation. Counter rotation can be resisted when there is a universal joint connected to the roller. If a wand or other driver which is connected to the joint is put at a sharp offset angle to the axis of the roller then the weight of the wand or slight holding force applied to it will resist rotation at the joint.

Another option is to interpose a gear box, for instance a worm gear box, between the wand and roller, because such a system by its nature resists counter rotation. Another way is to lock a wand against counter-rotation when there is only a flexible shaft connecting the wand and the roller. For example, the wand can be fastened to a window frame. Still another way is to make the handle-end of the wand hinged, so it can form a crank end that extends at an angle to the length of the rest of the wand; and the crank end may contact a window frame or a fitting or the shade itself.

However, there are situations in which it may be undesirable to have an element on the window frame to which the handle of a wand attaches, or to have a wand which has a crank end. Gear boxes may be expensive or slow down the speed at which the roller may be driven. When a universal joint is not well-aligned, i.e., when the driver is at a substantial angle to the driven parts, it may require a lot of force to turn the roller, and the motion can be unsmooth and difficult to the user.

Improved ways are still being sought, to simplify and improve the operation of a window treatment which is raised and lowered.

SUMMARY

An object of the invention is to provide a means for lifting a window treatment which prevents reverse rotation or unrolling of a shade or other window treatment part. A further object of the invention is to have a drive system for a lift-type window treatment which is easy to use and economic to construct.

In accord with an embodiment of the invention, a window treatment shade assembly comprises a shade which is alternately raised and lowered by reeling and unreeling the shade from a roller. The roller is rotated by a drive assembly which is connected to an end of the roller. The drive assembly is comprised of a flexible shaft connected to the roller; a universal joint connected to the flexible shaft; and, a means for rotating the universal joint, such as a wand, connected to the universal joint. Preferably, the universal joint is specially configured, and it is comprised of mating knuckles, each of which has a link with a slot; each link is engaged within the slot of the mating link. In a variation of the foregoing, a lifting member connected to a shade, such as a Roman shade, winds around the roller.

In exemplary use of the invention, the flexible shaft is spring-like and tends to bias the driven end of the universal joint toward the horizontal rotational axis of the roller. When the driven end of the universal joint is in such a location, the drive assembly is said to be in its home position. To raise or lower the shade, the wand which is connected to the driven end of the universal joint is pulled downwardly. That bends the flexible shaft downwardly, moving the drive assembly to its drive position; and it causes the links and thus the knuckles of the universal joint to align. The user then rotates the wand and turns the universal joint and thus rotates the roller, to raise and lower the shade to the desired elevation. When the desired setting is reached, the user lightly raises the wand upwardly, and then releases the wand. The universal joint will then be in the home position again, with knuckles at nominally right angles. Thus, the weight of the wand (and handle) hinders counter-rotation and unwinding of the shade from the roller. Unwinding is also prevented by contact of the wand with the wall or frame of the opening, or by contact with the fabric of the shade, according to the direction of the unrolling moment and the particular application.

In an embodiment of the invention the universal joint is comprised of specially configured mating knuckles. Preferably at least the driven knuckle has a U shape link with a slot which closely fits the head of the link of the mating knuckle; and, there is a wider portion of the slot near the inner end of the link, sufficient to enable rotation of one link within the slot of the other. The unique knuckles have particularly smooth driving action compared to a common universal joint and are particularly positive with respect to locking the roller in the desired position.

The foregoing and other objects, features and advantages of the present invention will become more apparent from the following description of preferred embodiments and accompanying drawings.

BRIEF DESCRIPTION OF THE DRAWINGS

FIG. 9 is particularly related to FIG. 3.

DESCRIPTION

The disclosure of provisional U.S. patent application Ser. No. 61/357,252, filed Jun. 22, 2010, entitled "Cordless Roman Shade with Self-Locking Handle" and the disclosure of commonly owned U.S. patent application Ser. No. 12/829,834 of M. Hanley et al., filed Jul. 2, 2010, and entitled "Handle with Anti-Rotation Mechanism for a Window Treatment," are hereby incorporated by reference.

Embodiments of the present invention relate to so-called cordless Roman shade window treatments, and means for raising and lowering such shades, which are described in the Ser. No. 12/829,834 application. The shades described in the application, and further below, may be used for other purposes than covering window openings, such as for other openings and spaces where it is desirable to adjustably control passage of light or matter.

Figures 1, 1A:
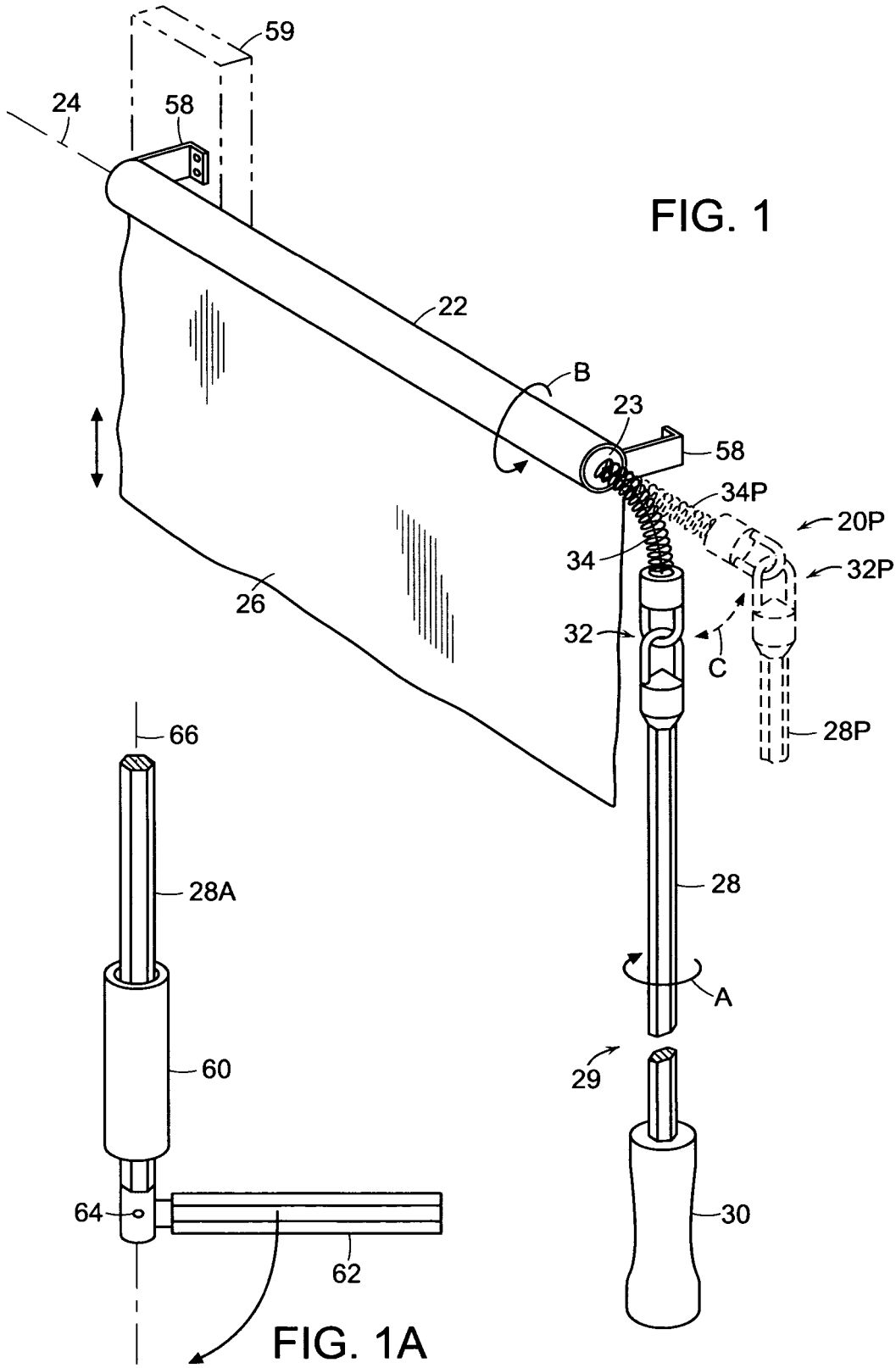
FIG. 1 is a perspective view of a shade on a roller with a driver mechanism comprised of a wand and joint in the drive position. The components are also shown in their home or lock position, in phantom.
FIG. 1A is a partial perspective view of the lower end of a wand having both a collar and an articulating crank end.

FIG. 1 shows a window treatment assembly embodiment comprising a shade 26 and associated driver 29, namely a wand 28 with handle 30, for actuating and raising and lowering the shade. For simplicity in the following description, reference is often made to the wand as representative of the actuator which may comprise several parts, e.g., the handle, and articulated end, and a collar as described below. Shade 26 is shown partially rolled around roller 23, the longitudinal axis of which is indicated by the line 24. The ends of the roller 23 are rotatably supported in brackets 58 which attach to a window frame or the like, not shown, but suggested by frame phantom 59 at one bracket. In the generality of the invention, the shade assembly is attached to some supporting structure during use.

A driver assembly 20 for raising and lowering the shade comprises a driver 29, a portion of which is wand 28, universal joint 32 to the lower end of which is attached a wand 28, and a flexible drive shaft 34 connecting roller 23 to the upper or near end of the universal joint, also referred to in particular as the knuckle joint. Flexible drive shaft 34 is preferably a tightly wound metal coil spring, an example of which is detailed below. Alternately, shaft 34 may be a piece of steel flexible shaft, well known in commerce. Shaft 34 may be connected to the end of the roller by various means, including that it may be force-fit or press-fit, pinned, or otherwise fastened within a cavity 25 at the end of the roller 23. See FIG. 2. The other end of the shaft 34 is connected to universal joint 32, in particular to the driven knuckle part 36. Similar alternative means of attachment may be used to connect the shaft to the knuckle body.

FIG. 1 shows the elements in their operating or drive position, and indicates how counter-clockwise rotary motion (arrow A) imparted to the handle end 30 of wand 28 by a user results in the shade 26 being raised up and wound (arrow B) as a reel of fabric 22 about the roller 23. FIG. 1 shows that the wand has a handle 30 at its lower end, to make easier gripping of the wand by the user, and to add mass to the driver/wand for resisting counter-rotation as explained below. A wand may have no handle and may be a simple polygonal cross section plastic shaft. Alternately, the wand may have a crank end as described below and as shown in FIG. 1A.

In FIG. 1 the driver assembly 20 is shown in its operating or drive position, wherein the joint 32 is more or less straight, due to the user having pulled downwardly on the driver 29 and having overcome the resilient, or bias, force of the preferred flexible shaft 34. FIG. 1 also shows, in phantom, the drive assembly and elements when they are in their rest or home position. The items designated 20P (assembly), 32P joint), 34P (shaft), 28P (wand), etc., are the same items as those having the number with no suffix P. The assembly 20 moves from its operating position to its rest position (indicated by arrow C) when the user lightly thrusts the wand 28 upwardly, as described in more detail further below. When shaft 34 has the aforementioned coil spring construction, or a structural analog, the bias created by the resilience of the flexible shaft aids the upward motion.

Figure 2:
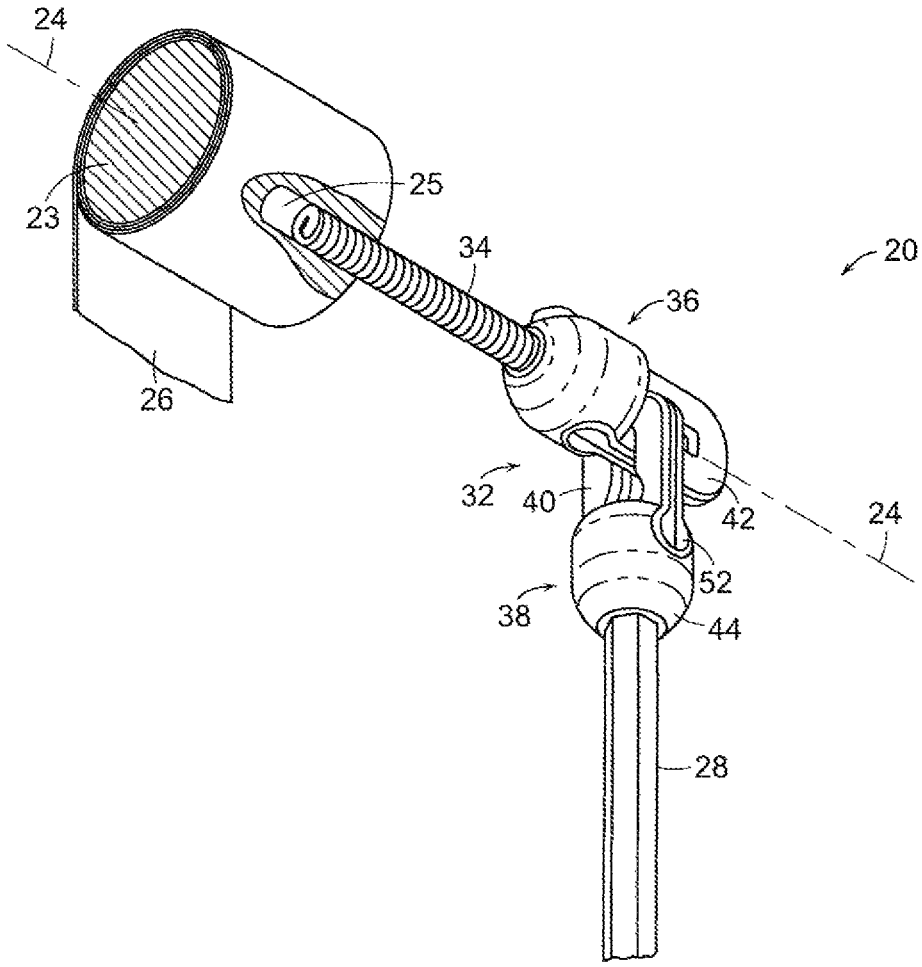
FIG. 2 is a perspective is a perspective view of the portions of the apparatus shown in FIG. 1, when in the home or lock position.
Figure 3:
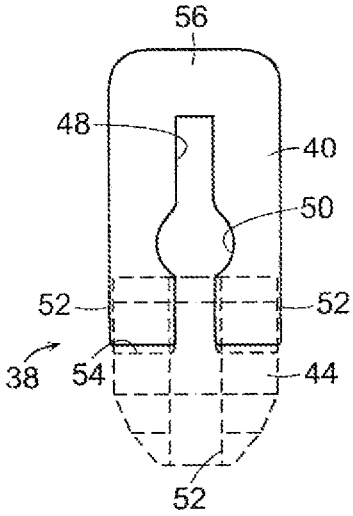
FIG. 3 is a side view of a U shape link of a knuckle, with the knuckle body in phantom.
Figure 8C:
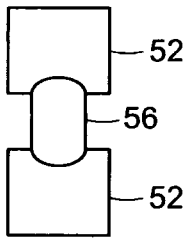
FIGS. 8A, 8B, and 8C are respectively side, edge, and end views of a U shape link of a knuckle.
Figure 8A:
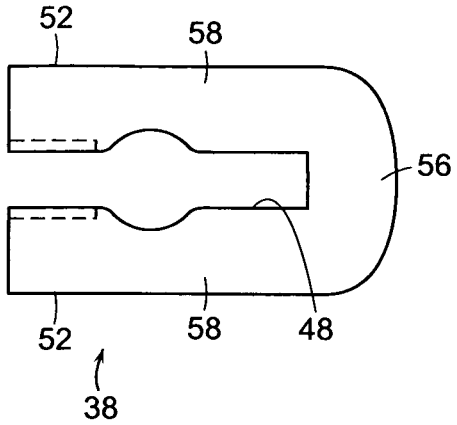
Figure 8B:
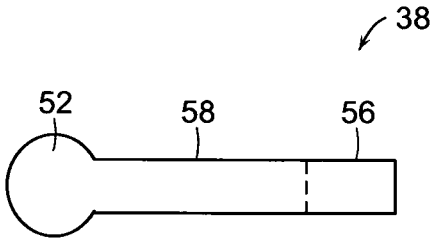
Figure 9:
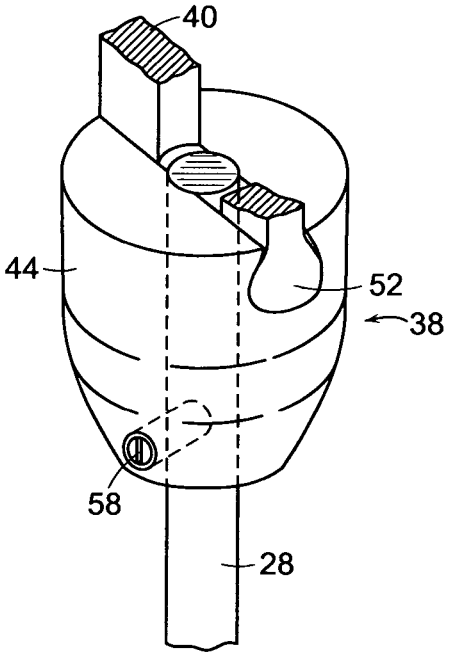
FIG. 9 is a quasi-isometric view of the body of a knuckle attached to the end of a wand, with the top part of the U shape link cut away.

FIG. 2 shows driver assembly 20 in more detail, in its rest position, where the parts of knuckle joint 32 are at a more or less right angle. Preferred joint 32 is comprised of two mating identical knuckle parts 36, 38. FIGS. 3, 8 and 9 detail the construction of typical knuckle part, or knuckle half, 38; and FIG. 5-7 detail the construction and function of the knuckle joint. These aspects are discussed further below.

When, as shown in FIG. 2, wand 28 and knuckle joint 32 are in their home positions (also called the lock position), and counter rotation of the roller 23 is resisted. This can be understood as follows: If the roller 23 starts to rotate, that motion is transmitted through driven knuckle 36. But knuckle 36 cannot rotate without also rotating with knuckle 38, the centerline of which is at an about right angle to the centerline of knuckle 36 when the drive assembly is in its home position. The counter-rotation force transmitted to knuckle 38 is such as to tend to lift the wand 28, to urge it to rotate toward a plane which is more of less perpendicular to the plane in which the shade and wand hang. (Alternately, when the shade winds around the roller in the opposite direction, counter-rotation will tend to push the wand into the plane of the window frame. Of course, the drive system may be moved to the opposite end of the roller from that shown in FIG. 1 and the wand rotational directions will be reversed.) The term "counter rotation" is used here mostly in the sense of referring to unwanted motion which unwinds the sheet from the roller.

The weight of the wand, and the distance of its center of mass from the axis of rotation of the knuckle joint, create a moment which opposes the counter-rotation moment generated by the weight of the shade as it seeks to unroll off the roller. In the embodiment of FIG. 1, the center of gravity of the wand will depend on the weight of the wand and handle 30. The distance between the center of gravity of the wand and the center of joint 32 will preferably be at least half the distance to the free end of the wand, i.e., half the distance to the outer end of handle 30, in the embodiment of FIG. 1 and FIG. 2.

When the system is in its rest position, and a user is not applying downward force to the wand, a preferred flexible shaft 34 has a stiffness and strength sufficient, to counter the weight of the wand and to cause the shaft 34 to approach a horizontal position, more or less in-line with, but still curving somewhat downward with respect to, the line of axis 24 of the roller. Another useful shaft 34 may have less stiffness or strength.

To raise or lower the shade, a user pulls downwardly on the wand 28, overcoming any resilient resistance to deflection of shaft 34. That causes the knuckle joint to move from the rest or lock position, shown in FIG. 2 and in phantom in FIG. 1, to the drive position, shown in FIG. 1.

Figure 4:
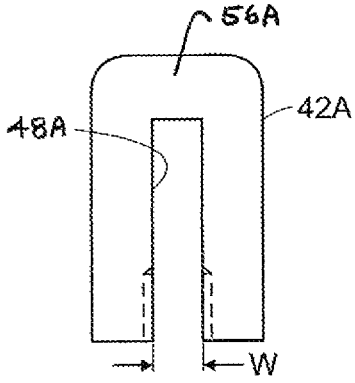
FIG. 4 is a side view of an alternative U shape link.
Figure 5:
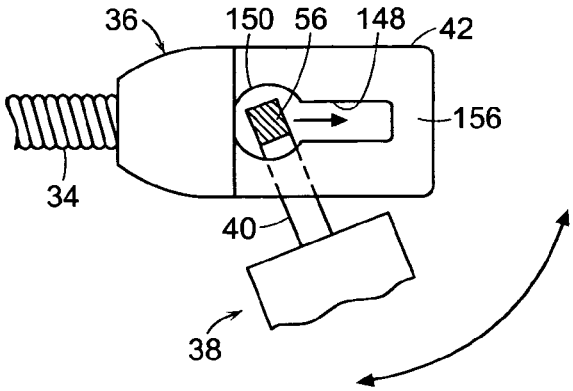
FIG. 5 is a side view showing how a drive knuckle moves from the rest or lock position to the drive position, relative to a driven knuckle, in a knuckle joint.

FIGS. 3 to 7 detail a preferred knuckle construction. FIG. 5 shows how the wand-driven knuckle 38 rotates relative to the other knuckle 36 with which it is engaged. (For simplicity and consistency with the other related Figures, FIG. 5 pictures the wand being rotated upwardly in the vertical plane, compared to the wand pulling the knuckle parts downwardly. The relative motion in Fig. is of course is the same relative motion which results when the wand and knuckle 38 are pulled downwardly.)

Both preferred embodiment knuckles have similar construction, which promotes economic production and assembly. (As indicated below they do not need to be identical in detail configuration.) With reference to FIG. 3 to FIG. 7, typical knuckle 38 comprises a U shape link 40 which has a slot 48. The slot has a wider portion 50 near the base or body 44 of the knuckle. When the wand is pulled downwardly, to bend the flexible shaft downward and thus to bring the links toward alignment, the wider portion of the slot enables the head 56 of drive knuckle 38 to rotate within the slot of the driven knuckle 36, as illustrated by FIG. 5.

Figure 7:
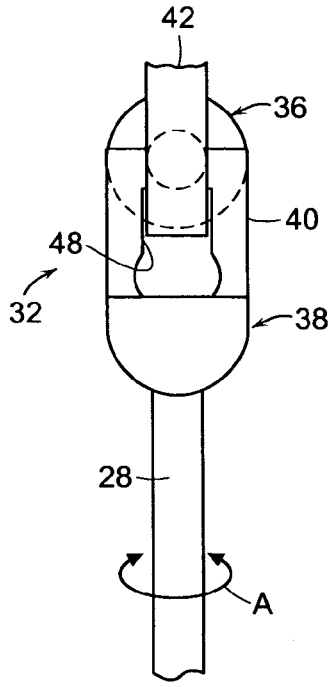
FIG. 7 is similar to FIG. 6B, and shows a knuckle joint in its drive position, corresponding in pictured orientation with FIG. 1.
Figure 6A:
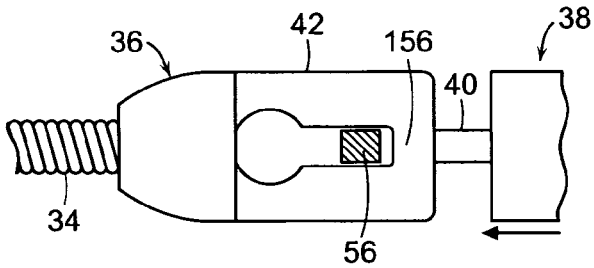
FIG. 6A shows two joint knuckles assembled in their drive position, with the driven knuckle 36 in side view.
Figure 6B:
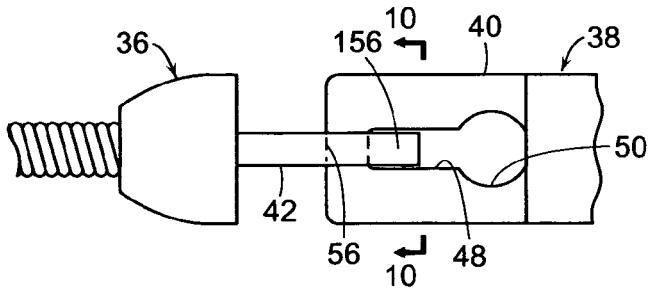
FIG. 6B shows the assembly of joint knuckles from FIG. 6A, with the driven knuckle 36 in top view.

The U shape link 40 has a cross piece or head 56 that connects the opposing legs which define the slot 48. Knuckle 36 is similarly configured, having a link 42, slot 148 with wider portion 150, and head 156. As the knuckles move into lengthwise alignment due to the user pulling on the wand, the head 56 of the link 40 of knuckle 38 slides lengthwise within the slot 48 of link 42 of knuckle 36. The resultant configuration is shown in FIG. 6A and FIG. 6B (which are respectively side and top views, and collectively referred to as FIG. 6). When the knuckles are aligned lengthwise, rotating of the wand and attached drive knuckle 38 will rotate driven knuckle 36 and shaft 34. FIG. 7 is like FIG. 6B; it is another view of the knuckle joint 32 in its drive position, but pictured to correspond with FIG. 1.

When the user stops turning the wand upon reaching the desired extension of the shade, the user raises the wand upwardly in the lengthwise direction of the wand, which is the reverse of the motions just described and illustrated by FIG. 5-6.

Note that the rectangular, preferably square, cross section of head 56 of knuckle 38 fits closely in the slot 148 of the mating knuckle 36. Thus, when moving from the drive to head position, the head 56 (and link 40) slides lengthwise in slot 148 of link 42 until it reaches the wider portion 150 at the base of the U shape link 42. At that location, the knuckle 40 is able to rotate relative to knuckle 42 because the space 150 allows rotation of the head within the slot. See FIG. 5. The resilient force of the preferred flexible shaft 34, and the continued light upward motion of the wand by the user, cause the knuckle 36 to resume its nominal horizontal position. The assembly will then reach the rest position (alternately called the home or lock position) shown in FIG. 2. The length dimensions of the different portions of the slot enable the aforementioned rotational motions.

The construction of a typical preferred knuckle is now described. Referring to FIG. 3 and FIG. 9, the wand 28 is received in a hole 52 in the body 44 of the knuckle 38. Link 40 is detailed in the three mutually orthogonal views of FIGS. 8A, 8B and 8C. Link 40 has legs with bulbous ends 52 which are gripped as they slide into the undercut of a transverse slot 54 of the body 44 when the assembly 20 is manufactured. Wand 28 is inserted into the cavity 52 next, so that the wand sticks upwardly in the space between the opposing side leg ends 52 of the link. That prevents the legs from moving laterally within the slot. Set screw 58 retains the wand in place. The other knuckle 36 is similarly constructed, except that it is the end of the flexible shaft 34 which keeps the bulbous leg ends of the link within the slot, instead of a wand.

In another embodiment of the invention, a link 42A, shown in FIG. 4, has a slot 48A which has a width W which is wider than the cross section of the head 56A and a uniformly wide slot portion—i.e., portion 50 which characterizes link 42, is absent and rotation of the head within the slot is possible along its whole length. Thus, the head 56, 56A of one knuckle can rotate relative to the other knuckle at any point along the length of the slot, because the slot 48A of a first knuckle is wide enough to enable rotation of the head 56A of a second identical knuckle to turn within the slot 48A. This embodiment has a less positive action since there is more "play" in the joint.

As will be appreciated, in the invention, both knuckles do not have to have identical construction, although making them so is an aid to economic mass production. In particular, the bases can have different configurations. And, a driven knuckle which has link defining a close head-fitting slot with wider portion (as shown in FIG. 3) may be used with a drive knuckle which has a plain, wide slot (as shown in FIG. 4).

The knuckle and universal joint construction described above is a special (and unique) case of a universal joint. A common universal joint, known in commerce, or a knuckle joint without the special fit of the preferred embodiment described above, may be used in carrying out the invention. As will be appreciated from the foregoing, a knuckle joint is one in which the mating parts which are engaged are loop shaped, preferably U-shape. Common universal joints and flexible shafts are commercially available from McMaster Carr, Inc., Robinsville, N.J.; although for common commercial window treatments lower cost and thus more primitive items may be preferred. The ease of operation and range of functionality may be less good when the embodiment comprises a commercial universal joint of a common knuckle joint. Even so, there will not be significant counter-rotation, by which is meant that the sheet will not unwind from the roller in a degree which is substantial compared to the mean useful extension of the sheet from the roller.

Figure 10:
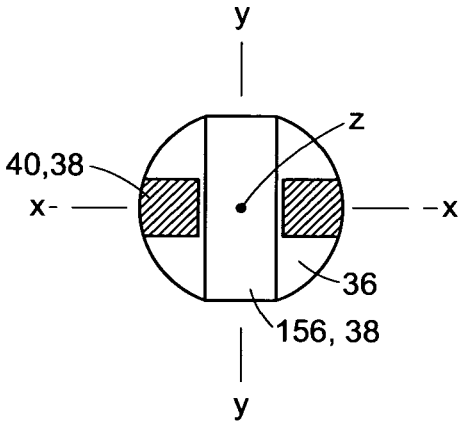
FIG. 10 is a vertical cross section through the link of knuckle 36 as shown in the assembly of FIG. 6B.

The reason for preference of the special configuration knuckle joint which is described in connection with FIG. 3-7 is as follows. Reference should be made to FIG. 10, which is a cross section through the knuckle assembly of FIG. 6B. When the parts of the knuckle joint are in a working or drive position, where the parts of the joint lie in some approximation of straight line (which could be nominally along the z-axis), the knuckle joint of the present invention has one degree of substantial freedom of movement, e.g., in the x plane looking along said z-axis straight line. In comparison, a common universal joint under the same situation will have two degrees of freedom, i.e., in the x-plane and in the orthogonal y-plane. Given that the flexible shaft 34 is "wiggly" and resiliently "wants" to go to its home position, there is a tendency for a common low cost universal-type joint, especially, for example, one having mating links or loops, to "kick" out of alignment when being driven. That makes the use of the driver (wand) more erratic and uncertain from the standpoint of operator perception. The unique construction of the invention knuckles overcomes those problems in a surprisingly straightforward and economic fashion.

The wand is preferably a hexagonal or round rod of semi-rigid extruded acrylic plastic or polyvinylchloride plastic. The wand may have other cross sections, such as square. The wand may be a solid or hollow rod, and may be made of another plastic or metal. Other components of the drive system are preferably made of POM (polyoxymethylene) plastic.

From the foregoing it will be appreciated that there is a desirable interrelationship between the flexible shaft and the joint, whether it be a preferred knuckle joint or some other universal joint.

In another embodiment of the invention, the handle portion 30 of the wand 28 may be hinged relative to the rest of the wand length at one, preferably two, places, to thereby form a crank handle. FIG. 1A shows alternate embodiment wand 28A which has a lower end 62 which is hinged at pivot pin 64, so it can move as illustrated by the arrow to a position nominally perpendicular to the length axis 66 of the wand. Such an articulate wand is said to have a crank end. FIG. 1A also shows collar 60, which may be a loosely-fit piece of semi-rigid or rigid plastic tubing within which wand 28A freely rotates, is positioned around the lower end of wand 28A. Thus, a user may grasp the collar and thereby steady the wand while applying the rotary force to the wand—in the instance of the crank end, by twirling the crank, often with a single finger. The collar may also be used on the wand in the embodiment of FIG. 1. In still another embodiment, the wand has a second hinged portion, so that the distal end of the wand may be made parallel to, but offset from, the wand portion which connects to the joint. See the related application Ser. No. 12/829,834.

While a simple wand, in its variations, is economic and effective, in the generality of the claimed invention the term wand and driver shall include other rotary drive means which are equivalent in function and result to a manually turned wand, for instance, an electric motor actuator connected to the universal joint directly, or by means of a wand or analogous structure.

The flexible shaft 34 is preferably a 2+ inch long tightly wound coil of 0.06 inch diameter music wire, i.e., hardened steel. It has an about one-quarter inch outside diameter. By "tightly wound" is meant that the adjacent turns of the coil are touching or nearly touching each other, i.e., the pitch of the turns of the coil is between 100 and 120 percent of the wire diameter. For reasons which are evident from the foregoing description, the shaft 34 is desirably resilient and sufficiently strong to help lift itself and the driven knuckle upwardly, when the user desires that to happen and pushes the wand upwardly.

In the generality of the invention, a flexible shaft need not have the resilience and "toward-horizontal" bias which has been described. In another embodiment of the invention, shaft 34 has insufficient resilience and or strength to overcome the weight of the wand, or none. When the shaft 34 has such character, the user may, after having changed the position of the shade by rotating the wand, raise the wand upwardly to thereby push the knuckle joint 32 upwardly, which will push the shaft 34 upwardly. That will cause the upper knuckle 36 to move to the horizontal home position, thereby enabling locking of the driver assembly. To the extent the shaft has such low strength that, upon release by the user, the weight of the wand will pull the shaft down to the point the knuckles become aligned, and the locking feature is defeated, the wand may be clipped to the frame of the window or a wall, as by a clip, magnetic means, etc. Alternately, when the handle is hinged to the rest of the wand length, as shown in FIG. 1A, the handle may be bent nominally perpendicular to the wand length, to thereby form a crank end which can be placed in contact with a window frame or a fitting or the shade itself, to thereby resist counter-rotation of the wand.

The co-pending patent application Ser. No. 12/829,834, referred to above, describes a Roman shade with which the invention is particularly useful. Roman shades often are made of relatively heavy fabric. In the invention of the application Ser. No. 12/829,834 the Roman shade is raised by rolling up a lifting element, that is, a fabric piece which is attached to the lower end of the shade. The lifting element and not the shade itself is wound around the roller when it is rotated. See for example FIG. 6 and FIG. 9 of the related application. Thus, in the generality of the invention, rotation of the roller by the drive assembly can directly or indirectly lift the shade of a window treatment.

The invention, with explicit and implicit variations and advantages, has been described and illustrated with respect to one or more embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail without departing from the spirit and scope of the claimed invention.

What is claimed is:

1. A window treatment assembly having a shade which may be alternately raised and lowered, comprising:

a rotatable roller, for accumulating sheet material around its periphery, when horizontally mounted by support means to a structure;

sheet material connected to the roller, for being wound and unwound from the roller when the roller rotates, and for directly or indirectly changing the elevation of the shade relative to said structure; and, a drive assembly, connected to an end of the roller, comprised of:

a flexible shaft connected to the roller;

a universal joint having a length axis connected to the flexible shaft; and, a driver for rotating the universal joint, connected to the universal joint;

wherein the universal joint is comprised of a drive element and a driven element, the two elements pivotably mated to each other; and, wherein the flexible shaft, universal joint, and driver of said drive assembly are movable between a rest position and a drive position; wherein, in the rest position the length axis of the drive element is at a sharp angle to the length axis of the driven element, and in the drive position the length axes of the drive element and driven element are more nearly aligned than they are in said rest position;

and, wherein said flexible shaft provides a resilient force within the drive assembly, to bias the drive assembly to the rest position.

2. The window treatment assembly of claim 1 wherein the sheet material is the shade.

3. The window treatment assembly of claim 1 wherein the shade is a Roman shade, wherein an end of the sheet material is attached to the shade so the shade is lifted by rotation of the roller and accumulation of sheet material thereon.

4. A window treatment assembly having a shade which may be alternately raised and lowered, comprising:

a rotatable roller, for accumulating sheet material around its periphery, when horizontally mounted by support means to a structure;

sheet material connected to the roller, for being wound and unwound from the roller when the roller rotates, and for directly or indirectly changing the elevation of the shade relative to said structure; and a drive assembly, connected to an end of the roller, comprised of:

a flexible shaft, connected to the roller;

a universal joint, connected to the flexible shaft; and, a driver, for rotating the universal joint, connected to the universal joint;

wherein the universal joint is comprised of a drive knuckle and a driven knuckle mated to each other; each knuckle having a length axis and comprising a body from which extends an engaged U shape link characterized by opposing side legs spaced apart to define a slot running along the length axis of the knuckle, and a head connecting ends of the legs which are furthest from the body; and, wherein the head of the drive knuckle is movably positioned within the slot of the mating driven knuckle, for lengthwise motion within the driven knuckle slot.

5. The window treatment assembly of claim 4 wherein the slot of at least the driven knuckle has a first portion of slot, distant from said body, within which the head of the mating drive knuckle cannot rotate, and a second wider portion of the slot, proximate the body within which said drive knuckle head can rotate.

6. The window treatment assembly of claim 4 wherein the legs of each said U shape link have bulbous ends by which U shape link is engaged with the body of the knuckle; wherein each said knuckle body has (a) a transverse undercut slot for receiving the bulbous ends of said U shape link and (b) a lengthwise centerline bore, for receiving a said flexible shaft or for receiving a wand for rotating the knuckle body, the bore intersecting the transverse undercut slot; wherein when a flexible shaft or wand is inserted in the bore, interference thereof with the ends of the U shape link at the transverse undercut slot location prevents movement of the bulbous ends out of the transverse undercut slot.

7. The window treatment assembly of claim 5 wherein the head of the drive knuckle is rectangular in cross section, wherein said head slidingly fits said first portion of the slot of said driven knuckle, and wherein said head is rotatable in said second wider portion of the slot of said driven knuckle.

8. The window treatment assembly of claim 5 wherein both knuckles have substantially the same shape.

9. The window treatment assembly of claim 4 wherein the flexible shaft, universal joint, and driver of said drive assembly are movable between a rest position and a drive position; wherein, in the rest position the length axis of the drive knuckle is at a sharp angle to the length axis of the driven knuckle, and in the drive position the length axes of the knuckles are more nearly aligned than they are in said rest position; and, wherein said flexible shaft provides a resilient force within the drive assembly, to bias the drive assembly to the rest position.

10. The window treatment assembly of claim 9 wherein the flexible shaft is a close coil of hardened steel wire.

11. The window treatment assembly of claim 4 wherein said driver comprises a wand.

12. The window treatment assembly of claim 11 wherein the driver further includes a handle or crank end.

13. The window treatment assembly of claim 12 wherein the driver further includes a collar around said wand in proximity to the handle, within which the wand may rotate.

14. A window treatment assembly comprising:

a rotatable roller, for accumulating sheet material around its periphery, when horizontally mounted by support means to a structure associated with a window opening;

sheet material connected to the roller, being wound and unwound from the roller when the roller rotates, to selectively uncover and cover at least a portion of said window opening; and, a drive assembly, connected to an end of the roller, comprised of:

a flexible shaft connected to the roller;

a universal joint connected to the flexible shaft; and, a driver for rotating the universal joint, connected to the universal joint;

wherein the universal joint is comprised of a drive element and a driven element, the two elements pivotably mated to each other; and, wherein the flexible shaft, universal joint, and driver of said drive assembly are movable between a rest position and a drive position; wherein, in the rest position the length axis of the drive element is at a sharp angle to the length axis of the driven element, and in the drive position the length axes of the drive element and driven element are more nearly aligned than they are in said rest position;

and, wherein said flexible shaft provides a resilient force within the drive assembly, to bias the drive assembly to the rest position.

15. A window treatment assembly comprising:

a rotatable roller, for accumulating sheet material around its periphery, when horizontally mounted by support means to a structure associated with a window opening;

sheet material connected to the roller, being wound and unwound from the roller when the roller rotates, to selectively uncover and cover at least a portion of said window opening; and, a drive assembly, connected to an end of the roller, comprised of:

a flexible shaft connected to the roller;

a universal joint connected to the flexible shaft; and, a driver for rotating the universal joint, connected to the universal joint;

wherein, (a) the universal joint is comprised of a drive knuckle and a driven knuckle mated to each other; each knuckle having a length axis and comprising (i) a body from which extends a U shape link engaged with the body, the U shape link characterized by opposing side legs spaced apart to define a slot running along the length axis of the knuckle, and (ii) a head connecting ends of the legs which are distant from the body; and wherein the head of the drive knuckle is movably positioned within the slot of the mating driven knuckle; and, wherein, (b) the flexible shaft, universal joint, and driver of said drive assembly are movable between a rest position and a drive position; wherein, in the rest position the length axis of the drive knuckle is at a sharp angle to the length axis of the driven knuckle, and in the drive position the length axes of the knuckles are more nearly aligned than they are in the rest position; and, wherein said flexible shaft provides a resilient force to the drive assembly, within bias the drive assembly to the rest position.

16. The window treatment assembly of claim 15 wherein the slot of at least the driven knuckle has a first portion of the slot, distant from said body, within which the head of the mating drive knuckle cannot rotate, and a second wider portion of the slot, proximate the body within which said drive knuckle head can rotate.

* * * * *